US007211358B2

(12) United States Patent
Miskinis et al.

(10) Patent No.: US 7,211,358 B2
(45) Date of Patent: May 1, 2007

(54) IMAGE CYLINDER SLEEVE FOR AN ELECTROPHOTOGRAPHIC MACHINE AND METHOD FOR PRODUCING SAME

(75) Inventors: Edward T. Miskinis, Rochester, NY (US); Steven O. Cormier, West Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 363 days.

(21) Appl. No.: 10/836,484

(22) Filed: Apr. 30, 2004

(65) Prior Publication Data

US 2005/0244730 A1 Nov. 3, 2005

(51) Int. Cl.
*G03G 5/14* (2006.01)

(52) U.S. Cl. ..... 430/60; 430/69

(58) Field of Classification Search ..... 430/60, 430/69, 131; 399/159
See application file for complete search history.

(56) References Cited

U.S. PATENT DOCUMENTS

| | | | | |
|---|---|---|---|---|
| 4,942,105 | A * | 7/1990 | Yu | 430/58.65 |
| 6,240,267 | B1 * | 5/2001 | Compera | 399/117 |
| 6,605,399 | B2 * | 8/2003 | Chowdry et al. | 430/62 |
| 2002/0155365 | A1 * | 10/2002 | Sorriero et al. | 430/64 |

* cited by examiner

*Primary Examiner*—John L Goodrow

(57) ABSTRACT

A photoconductive member for use in an electrophotographic machine includes a substrate having an inside and outside surface. An inner smoothing layer is disposed over the inside surface of the substrate thereby improving the compatibility of the photoconductive member with an air-mounting process by which the photoconductive member is operably associated with a mandrel.

28 Claims, 5 Drawing Sheets

IMAGE CYLINDER SLEEVE FOR AN ELECTROPHOTOGRAPHIC MACHINE AND METHOD FOR PRODUCING SAME

CROSS-REFERENCE TO RELATED APPLICATION

Reference is made to the following commonly assigned application, the disclosure of which is incorporated herein by reference:

U.S. patent application Ser. No. 10/836,756, filed on Apr. 30, 2004, by Edward T. Miskinis, et al., entitled, "PHOTOCONDUCTIVE MEMBER FOR AN ELECTROPHOTOGRAPHIC MACHINE AND METHOD OF FORMING SAME".

FIELD OF THE INVENTION

The present invention relates to image cylinders for electrophotographic machines. More particularly, the present invention relates to an image cylinder sleeve of an electrophotographic machine, and a method of producing same.

BACKGROUND OF THE INVENTION

Electrophotographic machines, such as, for example, copiers and printers, produce images by forming a latent image charge pattern on a photoconductive surface. The photoconductive surface carries the latent image through a developing station wherein pigmented toner particles are drawn by electrostatic attraction onto the latent image charge pattern on the photoconductive surface. An electric field is applied to transfer the image from the photoconductive surface onto either an intermediate transfer member or an image substrate, such as, for example, a piece of paper. Thereafter, the image is fixed, such as, for example, by fusing, to the image substrate.

In some electrophotographic machines, the photoconductive surface may be disposed upon an endless-loop belt. In other electrophotographic machines, the photoconductive surface is disposed on a cylindrical roller or drum, variously referred to as the image cylinder, photoconductive drum or photoconductive roller. Generally, the photoconductive drum includes an inner roller or mandrel over which a photoconductive sleeve is disposed. The mandrel is typically constructed of aluminum. The photoconductive sleeve is typically constructed from a metal substrate, such as, for example, nickel, onto which a photoconductive layer is applied.

Typically, the photoconductive sleeve is mounted to the inner roller or mandrel by an air mounting process, as is more particularly described hereinafter. Generally, the air mounting process is very sensitive to the surface characteristics of the inside surface of the photoconductive sleeve. A photoconductive sleeve having a relatively rough inside surface is difficult to air mount or may be incompatible with the air mounting process, whereas a photoconductive sleeve having a relatively smooth inside surface is compatible with the process of air mounting and is relatively easy to air mount.

However, several of the manufacturing processes used to produce the photoconductive sleeve, including, for example, the nickel plating process, the surface of the mandrel used in the plating process, the grain structure of the plated nickel, the acid etching process by which the nickel surface is cleaned, and other manufacturing processes, cause the inside surface of the photoconductive sleeve to be undesirably if not unacceptably rough for use in an air mounting process. Since it is the inside surface of the photoconductive sleeve that must be machined or smoothed, the use of conventional processes such as, for example, grinding or polishing, may be somewhat labor intensive, time consuming, and costly.

Therefore, what is needed in the art is a photoconductive sleeve for a photoconductive roller that is compatible with an air mounting process, and a method of manufacturing same.

SUMMARY OF THE INVENTION

The present invention provides a photoconductive member, such as, for example, a photoconductive sleeve, that has an improved compatibility with an air-mounting process by which the photoconductive member is operably associated with a mandrel.

The invention includes, in one form thereof, a photoconductive member having an inside and outside surface. An inner smoothing layer is disposed over the inside surface of the substrate. The inner smoothing layer improves the compatibility of the photoconductive member with the air-mounting process.

An advantage of the present invention is that the inner smoothing layer improves the compatibility of the photoconductive member with the air-mounting process.

Another advantage of the present invention is that the inner smoothing layer is formed at least in part by processes used to form other parts and/or layers of the photoconductive member and therefore additional processes may not be required.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE DRAWINGS

Figure 1:
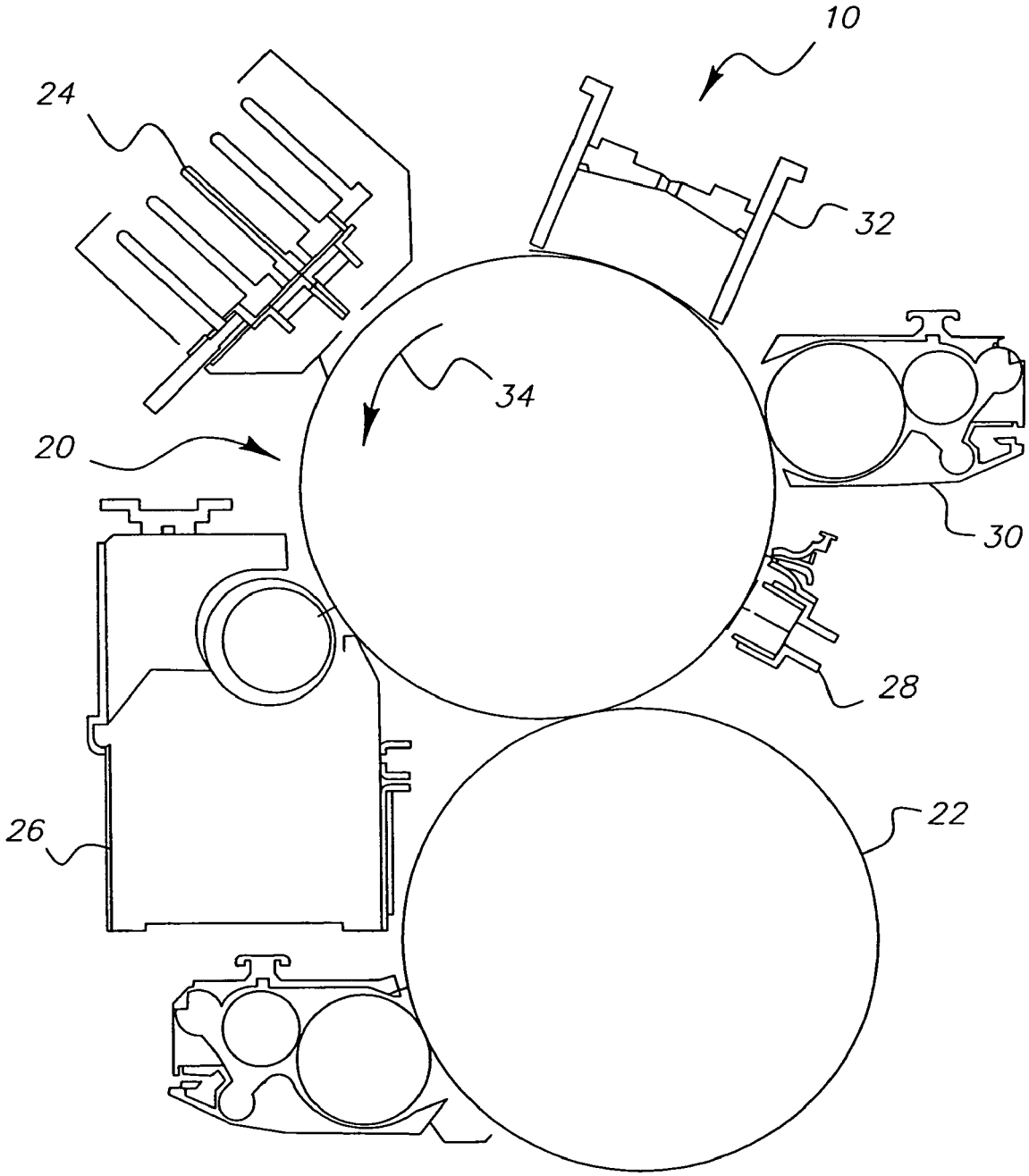
FIG. 1 is a schematic diagram of one embodiment of an electrophotographic machine having one embodiment of a photoconductive drum or image cylinder of the present invention.

Referring now to FIG. 1, there is shown a schematic diagram of one embodiment of an electrophotographic machine having one embodiment of a photoconductive roller of the present invention. Machine 10 includes photoconductive drum 20, transfer roller 22, writer or latent-image forming station 24, toning station 26, pre-cleaning station 28, cleaning station 30, and charging station 32.

Generally, photoconductive drum 20 is rotated in the direction of arrow 34 past charging station 32, which charges the outer photoconductive surface of photoconductive drum 20 to a uniform potential. Writer or latent-image forming station 24 selectively discharges the outer surface of photoconductive drum 20 to form thereon a latent charge image corresponding to the image to be printed or reproduced. As photoconductive drum 20 rotates through or past toning station 26 toner particles are electrostatically drawn to the outer surface of photoconductive drum 20 thereby developing the latent charge image. The developed image carried on the outer surface of photoconductive drum 20 is then transferred to transfer roller 22 and, from there, to an image substrate (not shown) that is brought into engagement with transfer roller 22. The outer surface of photoconductive drum 20 is then conditioned by a pre-cleaning station 28 and cleaned by cleaning stations 28 and 30, and the above-described cycle repeats.

Figure 2:
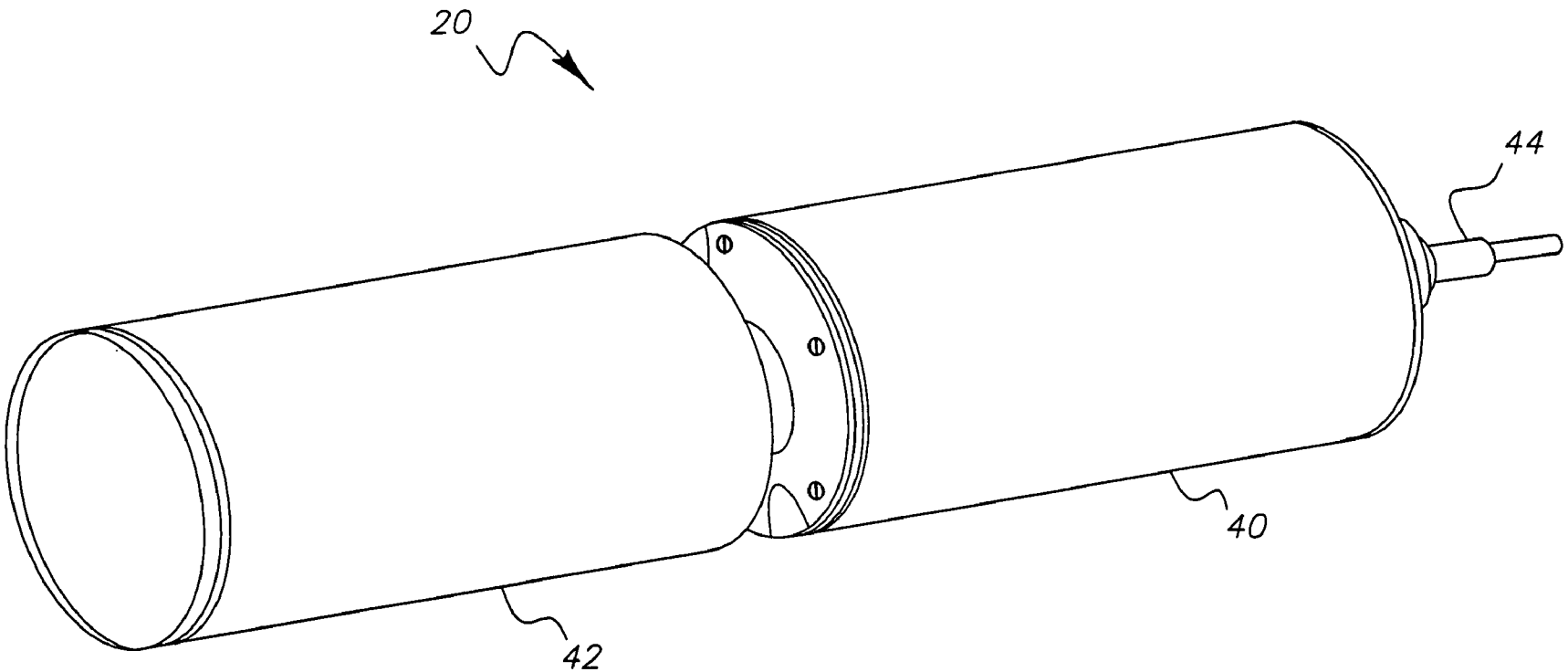
FIG. 2 is an exploded view of the photoconductive drum of FIG. 1.

Referring now to FIG. 2, an exploded view of photoconductive drum 20 is shown. Photoconductive drum 20 includes inner roller or mandrel 40 and one embodiment of an outer photo conductive sleeve 42 of the present invention. Mandrel 40 is typically constructed of metal, such as, for example, aluminum, and has a hard outer surface (not referenced) that is machined to a very smooth surface, such as, for example, by turning and/or polishing.

Photoconductive sleeve 42 is disposed upon and surrounds at least a portion of the outer surface of mandrel 40. Typically, photoconductive sleeve 42 is air mounted onto mandrel 40 and an interference fit exists or is formed therebetween.

Figure 3:
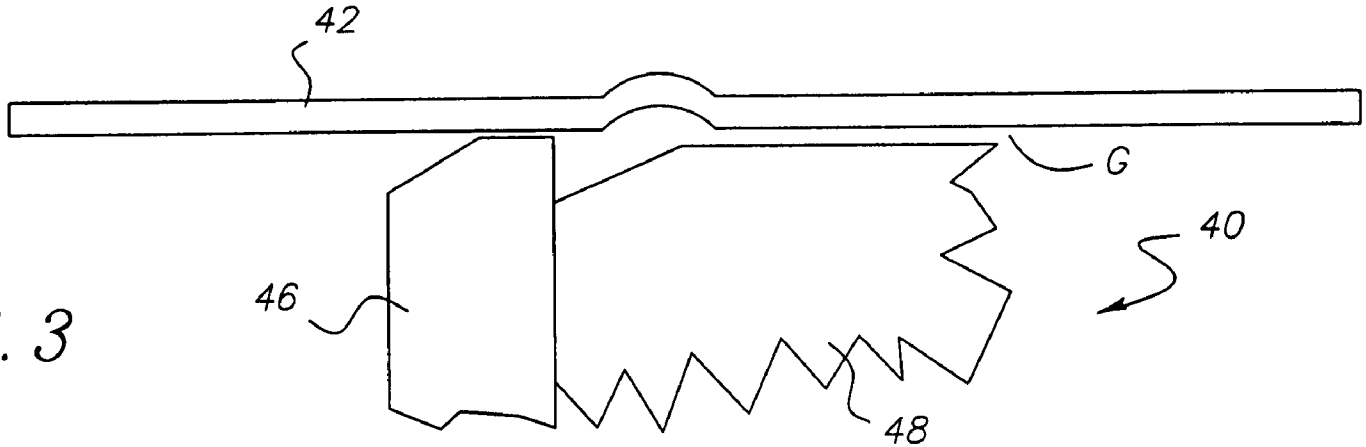
FIGS. 3 and 4 illustrate an exemplary air-mounting process by which a photoconductive sleeve is mounted to a mandrel.
Figure 4:
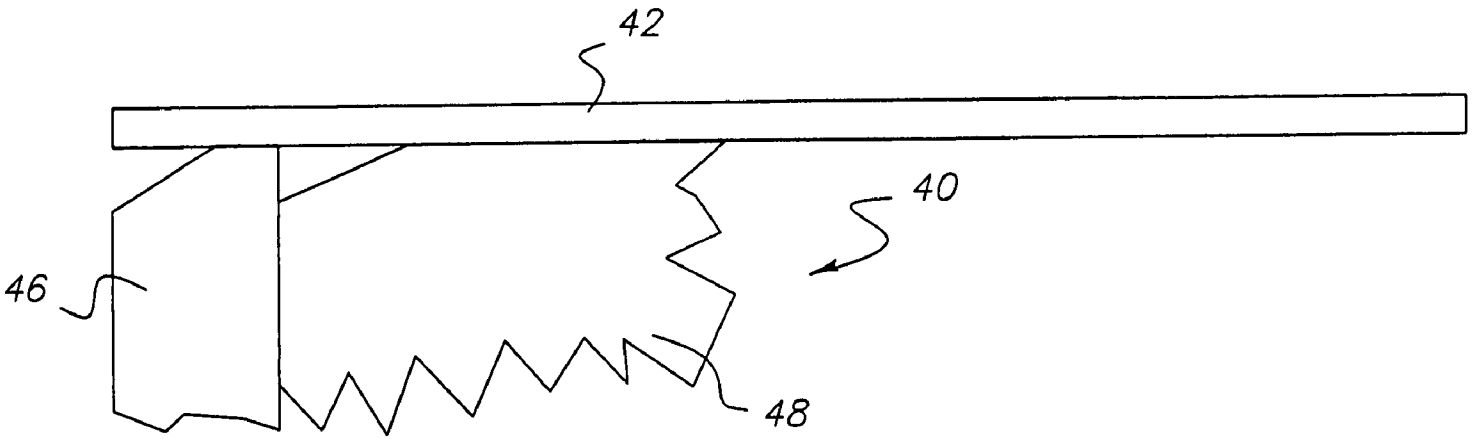

More particularly, mandrel 40 includes an air inlet 44 and, as shown in FIGS. 3 and 4, nose piece 46 and main body 48. Nose 46 is tapered and has a maximum diameter portion that has a diameter that is substantially equal to or slightly larger than the inside diameter of photoconductive sleeve 42 and which forms a seal with the inside surface of photoconductive sleeve 42. A supply of pressurized air is connected to air inlet 44 (see FIG. 2). Mandrel 40 is constructed (details are well known to one of ordinary skill in the art and thus are not shown) such that the pressurized air is channeled into a clearance formed between nose piece 46, a chamfered portion (not referenced) of body 48, and the inside surface (not referenced) of photoconductive sleeve 42. The pressurized air causes photoconductive sleeve 40 to temporarily expand and/or deflect outward, thereby forming gap G (FIG. 3) between the outer surface of body 48 and the inside surface of sleeve 42 that facilitates the sliding of photoconductive sleeve 42 over and onto body 48.

When photoconductive sleeve 42 is in the desired position over body 48 of mandrel 40, the air pressure supplied to mandrel 40 is removed and photoconductive sleeve 42 returns to its normal and undeflected inside diameter, as shown in FIG. 4. An interference fit is thereby formed between the inside surface of photoconductive sleeve 42 and the outer surface of body 48 of mandrel 40, and the outer surface of photoconductive sleeve 42 conforms to and/or takes the shape of the outer surface of body 48 of mandrel 40.

The process of air mounting is particularly sensitive to the characteristics of the inside surface of photoconductive sleeve 42. More particularly, in order to facilitate the air mounting process, the inside surface of photoconductive sleeve 42 must be relatively smooth. The smooth inside surface lowers insertion force, i.e., the force required to slide the sleeve over or relative to the mandrel. In order to be compatible with the air mounting process, the inside roughness of photoconductive sleeve 42 is preferably less than approximately 1.0 roughness average and less than approximately 2.0 roughness peak-to-peak, and more preferably from approximately 0.5 to approximately 0.20 roughness average and from approximately 1.5 to approximately 0.5 roughness peak-to-peak. However, sleeves typically have an inside roughness of approximately 0.5 roughness average and approximately 3.0 roughness peak-to-peak.

Since it is the inside surface of the photoconductive sleeve that must be smoothed, the use of conventional processes such as, for example, grinding or polishing, may be somewhat more difficult, time consuming, and costly. Further, in order to avoid undesirable imaging artifacts, the process or processes that might be used to smooth the inside surface of the photoconductive sleeve must not affect the smoothness of the outside photoconductive surface/coating of the photoconductive sleeve.

The present invention provides a photoconductive sleeve having an inside surface smoothness that is compatible with the air mounting process, and a method of producing such a photoconductive sleeve that utilizes existing processes and manufacturing methods and potentially requires no additional processes.

Figure 5:
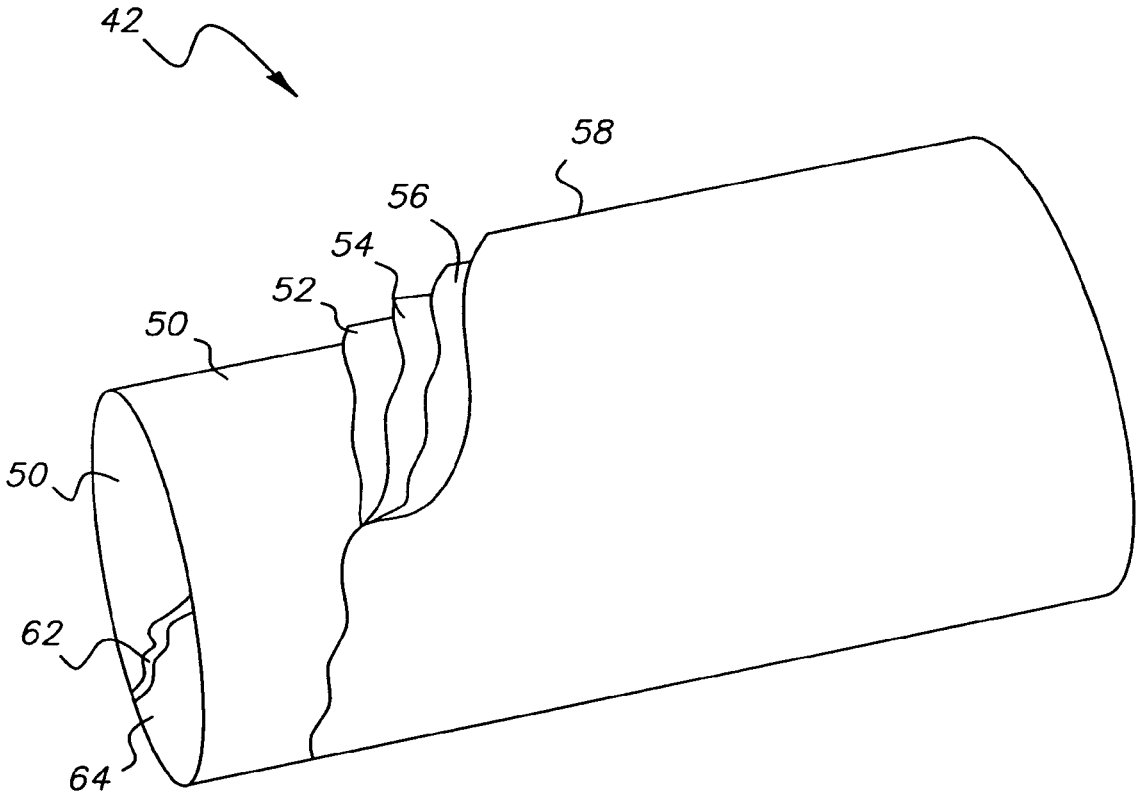
FIG. 5 is a cut-away cross-sectional view of the photoconductive sleeve of FIG. 2.

As best shown in FIG. 5, photoconductive sleeve 42 includes substrate 50, outer smoothing layer 52, outer barrier layer 54, charge generating layer (CGL) 56, charge transport layer (CTL) 58, inner smoothing layer 62, and inner barrier layer 64. Substrate 50 is constructed of metal, such as, for example, nickel, and has a thickness of, for example, from approximately 50 to approximately 200 microns (μ), and preferably from approximately 100 to approximately 150μ. Outer smoothing layer 52 is a layer of a polymer material and has a thickness of, for example, from approximately 2 to 4μ thick. Outer barrier layer 54 is a layer of a nylon material and has a thickness of, for example, from approximately 0.25 to 1.5μ thick. CGL layer 56 is a layer of hydrolyzed polyvinyl acetate material and has a thickness of, for example, from approximately 0.2 to 1.0μ. CTL layer 58 is a layer of polycarbonate material and has a thickness of, for example, from approximately 20 to 30μ thick.

Charge generating layer 56 and charge transport layer 58 are each formed by an entrapped-air dipping process. Generally, an entrapped-air dipping process is a process by which one end of sleeve 42 is capped or sealed in an air tight manner and the opposite, open end of sleeve 42 is dipped into a vat or tub of material. The outside surface of sleeve 42 is coated by the coating material. However, the air entrapped within sleeve 42 precludes to a substantial extent the coating material from entering into the open end of sleeve 42. The inside surface of sleeve 42 is left substantially uncoated. Thus, charge generating layer 56 and charge transport layer 58 are not formed or disposed upon the inside surface of substrate 50. Inner smoothing layer 62 is, however, formed and disposed upon the inside surface of substrate 50.

Inner smoothing layer 62 is a layer of polymer material disposed upon or over substrate 50. Inner smoothing layer 62 can be formed of the same or a different polymer than outer smoothing layer 62. Inner smoothing layer 62 is generally formed to a thickness that provides photoconductive sleeve 42 with an inside surface that is compatible with (i.e., of a sufficient smoothness) an air mounting process. More particularly, inner smoothing layer 62 is formed to a thickness that is sufficient to fill or substantially fill most or substantially all voids and other roughness on the inner surface of substrate 50 and thereby smooth the inside surface of photoconductive sleeve 42.

Inner barrier layer 64 is optionally formed upon and/or over inner smoothing layer 62. Inner barrier layer 64 is formed of a layer of nylon, and can be of the same or a different nylon material from which outer barrier layer 54 is formed. Inner barrier layer 64 supplements, when desired and/or necessary, the thickness of inner smoothing layer 62 to thereby ensure that most or substantially all voids and other roughness on the inner surface of substrate 50 are filled and thereby smooth the inside surface of photoconductive sleeve 42.

Figure 6:
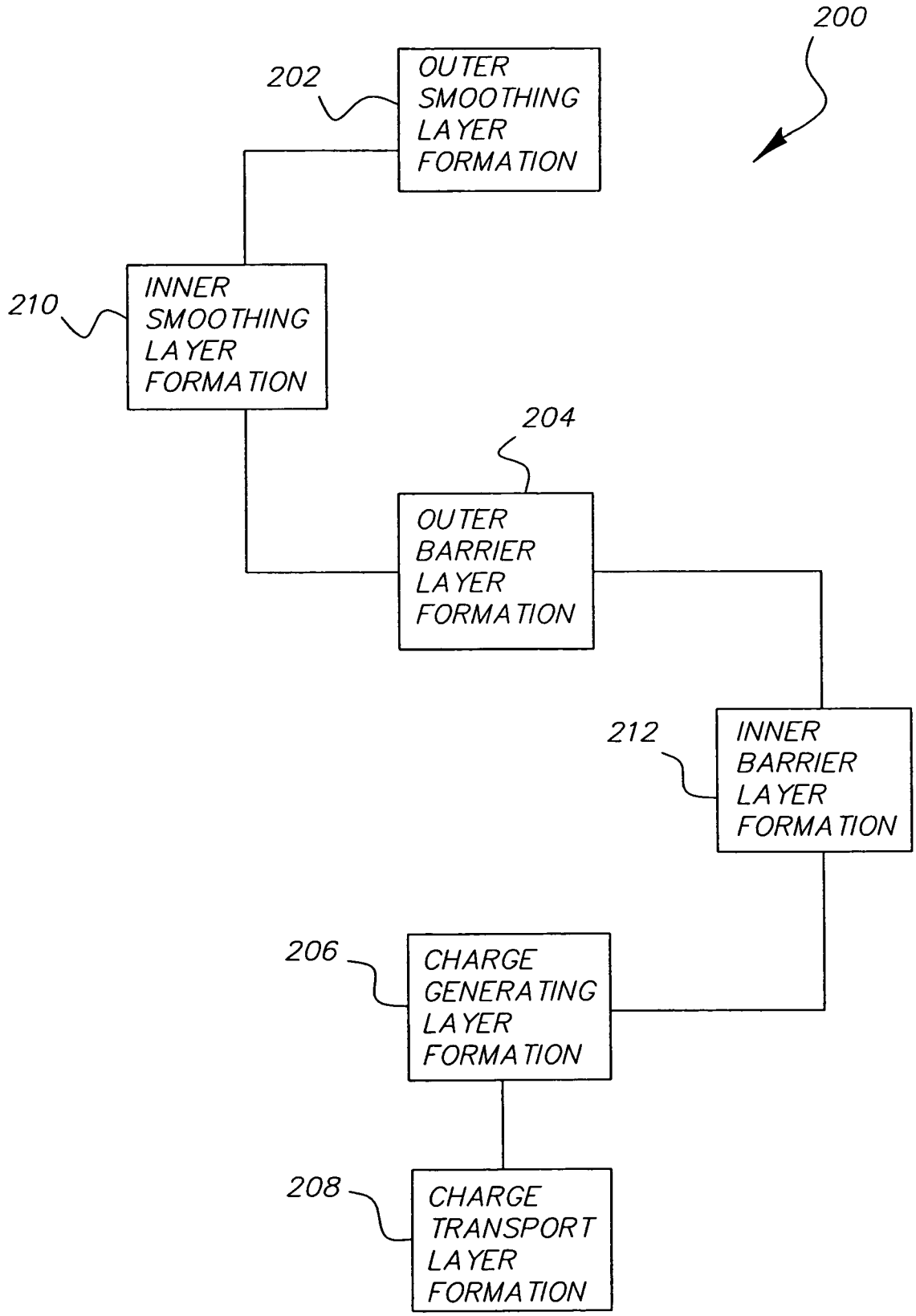
FIG. 6 is a process diagram illustrating one embodiment of a process of the present invention for producing a photoconductive member in accordance with the present invention.

Referring now to FIG 6, one embodiment of a process of the present invention for producing photoconductive sleeve 40 is shown. Process 200 generally includes outer smoothing layer formation 202, outer barrier layer formation 204, CGL formation 206, CTL formation 208, inner smoothing layer formation 210 and inner barrier layer formation 212.

Outer smoothing layer formation 202 places outer smoothing layer 52 upon and/or over substrate 50, such as, for example, by one of a normal dipping process or an entrapped-air dipping process. A normal (non-entrapped-air) dipping process coats the inside surface of substrate 50 with the same material from which outer smoothing layer 52 is formed and thereby results in the formation of inner smoothing layer 62 on and/or over the inside surface of substrate 50. Thus, using a normal (non-entrapped-air) dipping process causes the simultaneous formation of outer smoothing layer 52 and inner smoothing layer 62. Although shown as separate processes in FIG. 6, outer smoothing layer formation 202 and inner smoothing layer formation 210 are the same or simultaneous processes when outer smoothing layer formation 202 is conducted via a normal dipping process.

Conversely, when outer smoothing layer formation 202 is conducted via an entrapped-air dipping process, the coating of the inside surface of substrate 50 with the material from which outer smoothing layer 52 is formed is substantially precluded. Thus, inner smoothing layer formation 210 is not simultaneous with or the same process as outer smoothing layer formation 202 when outer smoothing layer formation 202 is an entrapped-air dipping process. Rather, inner smoothing layer formation 210 is a completely separate process when outer smoothing layer formation 202 is an entrapped-air dipping process.

Outer barrier layer formation 204 places outer barrier layer 54 upon and/or over outer smoothing layer 52 by, for example, a normal or entrapped-air dipping process. A normal (non-entrapped-air) dipping process coats inner smoothing layer 62 with the same material from which outer barrier layer 54 is formed and thereby results in the formation of inner barrier layer 64 on and/or over inner smoothing layer 62. Thus, using a normal (non-entrapped-air) dipping process causes the simultaneous formation of outer barrier layer 54 and inner barrier layer 64. Although shown as separate processes in FIG. 6, outer barrier layer formation 204 and inner barrier layer formation 212 are the same or simultaneous processes when outer barrier layer formation 204 is conducted via a normal dipping process.

Conversely, when outer barrier layer formation 204 is conducted via an entrapped air dipping process, the coating of inner smoothing layer 52 with the material from which outer barrier layer is formed is substantially precluded. Thus, inner barrier layer formation 212 is not simultaneous with or the same process as outer barrier layer formation 204 when outer barrier layer formation 204 is an entrapped-air dipping process. Rather, inner barrier layer formation 212 is a completely separate process when outer barrier layer formation 204 is an entrapped-air dipping process.

It should be particularly noted that the thicknesses of outer smoothing layer 52 and/or outer barrier layer 54 can, if desired, be increased by respective entrapped-air dipping processes and can use the same or a different material than used in any preceding non entrapped-air formation processes 202, 204, respectively.

CGL formation process 206 places CGL layer 56 upon and/or over outer barrier layer 54 by, for example, an entrapped-air dipping process. Similarly, CTL formation process 208 places CGL layer 56 upon and/or over CGL layer 56 by, for example, an entrapped-air dipping process.

In the embodiments shown, photoconductive sleeve 24 is configured as a cylindrical member. However, it is to be understood that the photoconductive member can be configured in other geometrical shapes.

In the embodiments shown, the photoconductive sleeve of the present invention includes an inner smoothing layer that is shown and described as being a specific layer of material. However, it is to be understood that the photoconductive sleeve of the present invention can be alternately configured with an inner smoothing layer that is formed from the same material as and/or by the same processes as one or more of the other layers that are formed upon and/or over the outer surface of the substrate of the photoconductive sleeve, such as, for example, the outer barrier layer or other suitable layers of material that are applied onto and/or over the outer surface of the substrate.

While this invention has been described as having a preferred arrangement, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

PARTS LIST

10. Machine
20. Photoconductive member or drum
22. Transfer Roller
24. Writer Station
26. Toning Station
28. Precleaning Station
30. Cleaning Station
32. Charging Station
40. Mandrel
42. Photoconductive Sleeve
44. Air Inlet
46. Nose Piece
48. Main Body
50. Substrate
52. Outer Smoothing Layer
54. Barrier Layer
56. Charge Generating Layer
58. Charge Transfer Layer
62. Inner Smoothing Layer
64. Inner Barrier Layer
200. Process
202. Outer Smoothing Layer Formation
204. Barrier Layer Formation
206. Charge Generating Layer Formation

208. Charge Transfer Layer Formation
210. Inner Smoothing Layer Formation
212. Inner Barrier Layer Formation
G Gap

What is claimed is:

1. A photoconductive member, for air mounting on a mandrel, for use in an electrophotographic machine, comprising:

a substrate having an inside and outside surface;

an inner smoothing layer disposed over said inside surface of said substrate to facilitate air mounting of said photoconductive member on the mandrel; and an inner barrier layer disposed over said inner smoothing layer.

2. The photoconductive member of claim 1, wherein said inner smoothing layer is a polymer.

3. The photoconductive member of claim 1, wherein said substrate is a metal.

4. The photoconductive member of claim 3, wherein said metal is nickel.

5. The photoconductive member of claim 1, wherein said inner barrier layer is a layer of nylon.

6. A photoconductive member, for air mounting on a mandrel, for use in an electrophotographic machine, said photoconductive member comprising:

a substrate having an inside and an outside surface;

an outer smoothing layer disposed over said outside surface of said substrate;

an outer barrier layer disposed over said outer smoothing layer;

a charge generating layer disposed over said outer barrier layer;

a charge transport layer disposed over said charge generating layer;

an inner smoothing layer disposed over said inside surface of said substrate to facilitate air mounting of said photoconductive member on the mandrel; and an inner barrier layer disposed over said inner smoothing layer.

7. The photoconductive member of claim 6, wherein said inner smoothing layer is a polymer.

8. The photoconductive member of claim 7, wherein said inner smoothing layer and said outer smoothing layer each is a polymer.

9. The photoconductive member of claim 8, wherein said inner smoothing layer and said outer smoothing layer are the same polymer.

10. The photoconductive member of claim 6, wherein said substrate is a metal.

11. The photoconductive member of claim 10, wherein said metal is nickel.

12. The photoconductive member of claim 6, wherein said inner barrier layer is nylon.

13. The photoconductive member of claim 6, wherein said inner barrier and said outer barrier layer are nylon.

14. The photoconductive member of claim 13, wherein said inner barrier and said outer barrier layer are the same nylon.

15. An image cylinder for an electrophotographic machine, comprising:

a mandrel configured for being operably disposed within the electrophotographic machine, said mandrel having an outer surface; and a photoconductive member operably associated with said mandrel, said photoconductive member including a substrate having an inside and an outside surface, said inside surface of said substrate surrounding at least a portion of said outer surface of said mandrel, an inner smoothing layer disposed over said inside surface of said substrate to facilitate air mounting of said photoconductive member on said mandrel, and an inner barrier layer disposed over said inner smoothing layer.

16. The image cylinder of claim 15, wherein said inner smoothing layer is a polymer.

17. The image cylinder of claim 16, wherein said photoconductive member further had an outer smoothing layer disposed over said outside surface of said substrate, said outer smoothing layer being a polymer.

18. The image cylinder of claim 17, wherein said inner and outer smoothing layers are the same polymer.

19. The image cylinder of claim 15, wherein said inner barrier layer is a layer of nylon.

20. The image cylinder of claim 19, wherein said photoconductive member further includes:

an outer smoothing layer disposed over said outside surface of said substrate; and an outer baffler layer disposed over said outer smoothing layer.

21. The image cylinder of claim 20, wherein said inner and outer barrier layers are the same nylon material.

22. A method for improving the compatibility of a photoconductive member with a mandrel for an air-mounting process by which the photoconductive member is mounted on the mandrel, comprising:

forming an inner smoothing layer over an inside surface of the photoconductive member to facilitate air mounting of said photoconductive member on the mandrel; and forming an inner barrier layer disposed over said inner smoothing layer.

23. The method of claim 22, wherein said forming step is a dipping process.

24. The method of claim 22, wherein said inner smoothing layer is a polymer.

25. The method of claim 22, wherein said forming step includes simultaneously forming at least part of an outer smoothing layer on an outside surface of the photoconductive member.

26. The method of claim 22, wherein said further process of forming is a dipping process.

27. The method of claim 22 wherein said inner barrier layer is a layer of nylon.

28. The method of claim 22 wherein the further process of forming includes simultaneously forming an outer barrier layer over said outer smoothing layer.

* * * * *

UNITED STATES PATENT AND TRADEMARK OFFICE

CERTIFICATE OF CORRECTION

PATENT NO. : 7,211,358 B2
APPLICATION NO. : 10/836484
DATED : May 1, 2007
INVENTOR(S) : Edward T. Miskinis et al.

It is certified that error appears in the above-identified patent and that said Letters Patent is hereby corrected as shown below:

Column 8, line 2, claim 17 Delete “had” and insert --has--

Column 8, line 28, claim 20 Delete “baffler” and insert --barrier--

Signed and Sealed this

Sixteenth Day of October, 2007

JON W. DUDAS
*Director of the United States Patent and Trademark Office*